US006902371B2

(12) United States Patent
Anderson, Jr. et al.

(10) Patent No.: US 6,902,371 B2
(45) Date of Patent: Jun. 7, 2005

(54) INTERNAL LOW PRESSURE TURBINE CASE COOLING

(75) Inventors: Henry Calvin Anderson, Jr., West Chester, OH (US); Frederick J. Zegarski, Cincinnati, OH (US); James Edward Thompson, Middletown, OH (US); Tod Kenneth Bosel, Cincinnati, OH (US); Kurt Thomas Hildebrand, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 389 days.

(21) Appl. No.: 10/206,601

(22) Filed: Jul. 26, 2002

(65) Prior Publication Data

US 2004/0018081 A1 Jan. 29, 2004

(51) Int. Cl.[7] ..... F01D 5/14
(52) U.S. Cl. ..... 415/115; 415/116
(58) Field of Search ..... 415/115, 116

(56) References Cited

U.S. PATENT DOCUMENTS

| | | | | |
|---|---|---|---|---|
| 4,242,042 A | | 12/1980 | Schwarz | |
| 4,303,371 A | | 12/1981 | Eckert | |
| 4,329,113 A | * | 5/1982 | Ayache et al. | 415/116 |
| 4,826,397 A | * | 5/1989 | Shook et al. | 415/116 |
| 5,167,487 A | | 12/1992 | Rock | |
| 5,188,507 A | | 2/1993 | Sweeney | |
| 5,292,227 A | | 3/1994 | Czachor et al. | |
| 5,438,756 A | | 8/1995 | Halchak et al. | |
| 5,553,999 A | | 9/1996 | Proctor et al. | |
| 5,584,651 A | | 12/1996 | Pietraszkiewicz et al. | |
| 5,593,277 A | | 1/1997 | Proctor et al. | |
| 5,609,466 A | * | 3/1997 | North et al. | 415/115 |
| 5,848,854 A | | 12/1998 | Brackett | |
| 5,993,150 A | | 11/1999 | Liotta et al. | |
| 6,164,656 A | | 12/2000 | Frost | |

OTHER PUBLICATIONS

"Detailed Flow Simulation: GE90 Turbofan Engine", http://hpcc.grc.nasa.gov/ge90.shtml, 2 pages.
"Center for Integrated Turbulence Simulations Aircraft gas turbine engine program", http://ctr–sgil.stanford.edu/CITS/engine.html, 3 pages.

* cited by examiner

*Primary Examiner*—Hoang Nguyen
(74) *Attorney, Agent, or Firm*—William Scott Andes; Steven J. Rosen

(57) ABSTRACT

A low pressure turbine casing has a conical annular shell circumscribed about a centerline. A forward flange depends from a forward end of the annular shell and a forward hook extends aftwardly from the forward flange. First and second rails having first and second hooks, respectively, extend aftwardly from the annular shell. First and second cooling holes extend through the first and second rails, respectively. Cooling air feed holes extend through the forward flange. The first and second cooling holes may be radially disposed through the first and second rails, respectively, with respect to the centerline or disposed through the first and second rails at an oblique angle with respect to the centerline. A low pressure turbine casing and shroud assembly further includes a first annular cavity in fluid flow communication with the first cooling holes and the second cooling holes. A second annular cavity is in fluid flow communication with the first and second cooling holes.

25 Claims, 9 Drawing Sheets

INTERNAL LOW PRESSURE TURBINE CASE COOLING

BACKGROUND OF THE INVENTION

1. Field of the Invention

This invention relates to cooling of casing of low pressure turbine case of a gas turbine engine and, more particularly, to such cooling by flowing cooling air between shrouds and the case.

2. Description of Related Art

A gas turbine engine of the turbofan type generally includes a forward fan and booster compressor, a middle core engine, and an aft low pressure power turbine (LPT). The core engine includes a high pressure compressor, a combustor, and a high pressure turbine in a serial flow relationship. The high pressure compressor and high pressure turbine of the core engine are interconnected by a high pressure shaft to the high pressure rotor. The high pressure compressor is rotatably driven to compress air entering the core engine to a relatively high pressure. This high pressure air is then mixed with fuel in the combustor and ignited to form a high energy gas stream. The gas stream flows aftwardly and passes through the high pressure turbine, rotatably driving it and the high pressure shaft which, in turn, rotatably drives the compressor.

The gas stream leaving the high pressure turbine is expanded through a low pressure turbine. The low pressure turbine rotatably drives the fan and booster compressor via a low pressure shaft, all of which form the low pressure rotor. The low pressure shaft extends through the high pressure rotor. Most of the thrust produced is generated by the fan. Engine frames are used to support and carry the bearings which, in turn, rotatably support the rotors. Conventional turbofan engines have a fan frame, a turbine center frame, and an aft turbine frame.

The turbine center frame typically has an external casing and an internal hub which are attached to each other through a plurality of multiple radially extending struts. A flowpath frame liner provides a flowpath that guides and directs hot engine gases through the frame and is not intended to carry any structural loads. Cooling air may be introduced into an annular chamber between the external casing and a radially outer flowpath liner of the flowpath frame liner, such as in the GE90. The flowpath frame liner protects the struts and rest of the frame from the hot gases passing through the frame.

Downstream of the turbine center frame is the low pressure turbine. Hot flowpath gases ingested into cavities between the casing and outer flowpath components could transfer heat into the casing by convection. The heat increases the metal temperatures of the casing and in turn reduces the useful life of the casing materials due to low cycle fatigue. The time-dependent properties of the casing material become limiting and unacceptable permanent casing deformations occur that adversely affect interstage turbine clearances, thereby reducing component service life of the casing.

Cooling by way of purge air is provided to annular cavities between the low pressure turbine casing, which for the GE90 is a single piece ring extending across six low pressure stages, and alternating blade shroud segments and low pressure turbine nozzle band segments from which are radially inwardly suspended turbine vane airfoils. Purge air 98 from a turbine center frame 100 of the GE90 engine illustrated in FIGS. 1 and 2 travels through a flow circuit into a small first stage stator cavity 112 and is bounded by an aft 100 rail of a turbine center frame case, a low pressure turbine flange 110 of a low pressure turbine casing 111, and a trailing edge 114 of a first stage stator flowpath outer band 116. Flow passages 118 at a forward lip 120 of a first stage low pressure turbine shroud 122 permits purge air flow to enter a first cavity 124 between the low pressure turbine casing 111 and above the first stage shroud 122. Leakage paths 128 at an aft end 130 of the first cavity 124 and shroud allow the purge air to exit the first cavity. The purge air circuit produces a small reduction in the low pressure turbine casing 111 and low pressure turbine stage one shroud 122 metal temperatures. The ability to purge cooling air from the first cavity 124 above the shroud controls the amount of flowpath gas that can enter the first cavity. The purge or cooling air flow reduces the convection heating of the LPT casing shell. The exiting of this cooling air reduces the heat transfer from the shroud to the LPT Casing by convection and conduction.

Therefore, it would be very beneficial to be able to improve the amount and control of purge air flow in the cavities above shrouds and turbine nozzle bands in the low pressure turbine. It has been found to be particularly useful to cool the first two of these cavities in order to cool the shell of the low pressure casing.

BRIEF DESCRIPTION OF THE INVENTION

A low pressure turbine casing has a conical annular shell circumscribed about a centerline, a forward flange radially inwardly depending from a forward end of the annular shell, and a forward hook extending axially aftwardly from the forward flange. Axially spaced apart annular first and second rails having first and second hooks, respectively, extend axially aftwardly from the annular shell and are located axially aft of the forward hook. First and second pluralities of first and second cooling holes extend through the first and second rails, respectively. In the exemplary embodiment, a plurality of cooling air feed holes extend through the forward flange. The plurality of cooling air feed holes may be substantially parallel to the centerline. The first and second pluralities of first and second cooling holes may be radially disposed through the first and second rails, respectively, with respect to the centerline or disposed through the first and second rails at an oblique angle with respect to the centerline.

The low pressure turbine casing may be used in a low pressure turbine casing and shroud assembly having a forward flange radially inwardly depending from a forward end of the annular shell, a forward hook having a forward annular slot and extending axially aftwardly from the forward flange. An annular first shroud is spaced radially inwardly of the annular shell and has a forwardly extending first forward lip disposed in the forward annular slot. An aft flange of the first shroud is mounted to the first hook with an annular C-clip having an annular radially outer leg disposed in a first annular slot.

A first annular cavity is radially disposed between the annular shell and the first shroud, axially extends from the forward flange to the first hook, and is in fluid flow communication with the first plurality of first cooling holes. An annular nozzle retainer is axially trapped between a turbine flange and the forward flange. Cooling air flow first passageways extend from an annular cooling air plenum through the turbine flange, the annular nozzle retainer, and the forward flange, to the first annular cavity. The first passageways may include axially and radially open channels through the turbine flange, radially elongated holes extending axially through the annular nozzle retainer, and a plurality of cooling air feed holes extending through the forward flange to the first annular cavity.

A radially outer turbine vane band is suspended radially inwardly from the first and second hooks by first and second turbine vane flanges. An annular seal radially disposed between the annular shell and the outer turbine vane band and axially extends between the first and second turbine vane flanges. A second annular cavity is radially disposed between the annular shell and the annular seal, axially extends between the first and second rails, and is in fluid flow communication with the first and second pluralities of first and second cooling holes.

The low pressure turbine casing and low pressure turbine casing and shroud assembly can reduce the amount of hot flowpath gases ingested into cavities between the casing and LPT shrouds and nozzle bands and reduce the amount of heat transferred into the casing by convection. This lowers the operating metal temperatures of the casing and, in turn, increases the useful service life of the casing whose materials are subject to heat enhanced low cycle fatigue.

The low pressure turbine casing and low pressure turbine casing and shroud assembly can improve the amount and control of purge air flow in the cavities above shrouds and turbine nozzle bands in the low pressure turbine, particularly useful in the first two of these cavities, in order to cool the shell of the low pressure casing.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
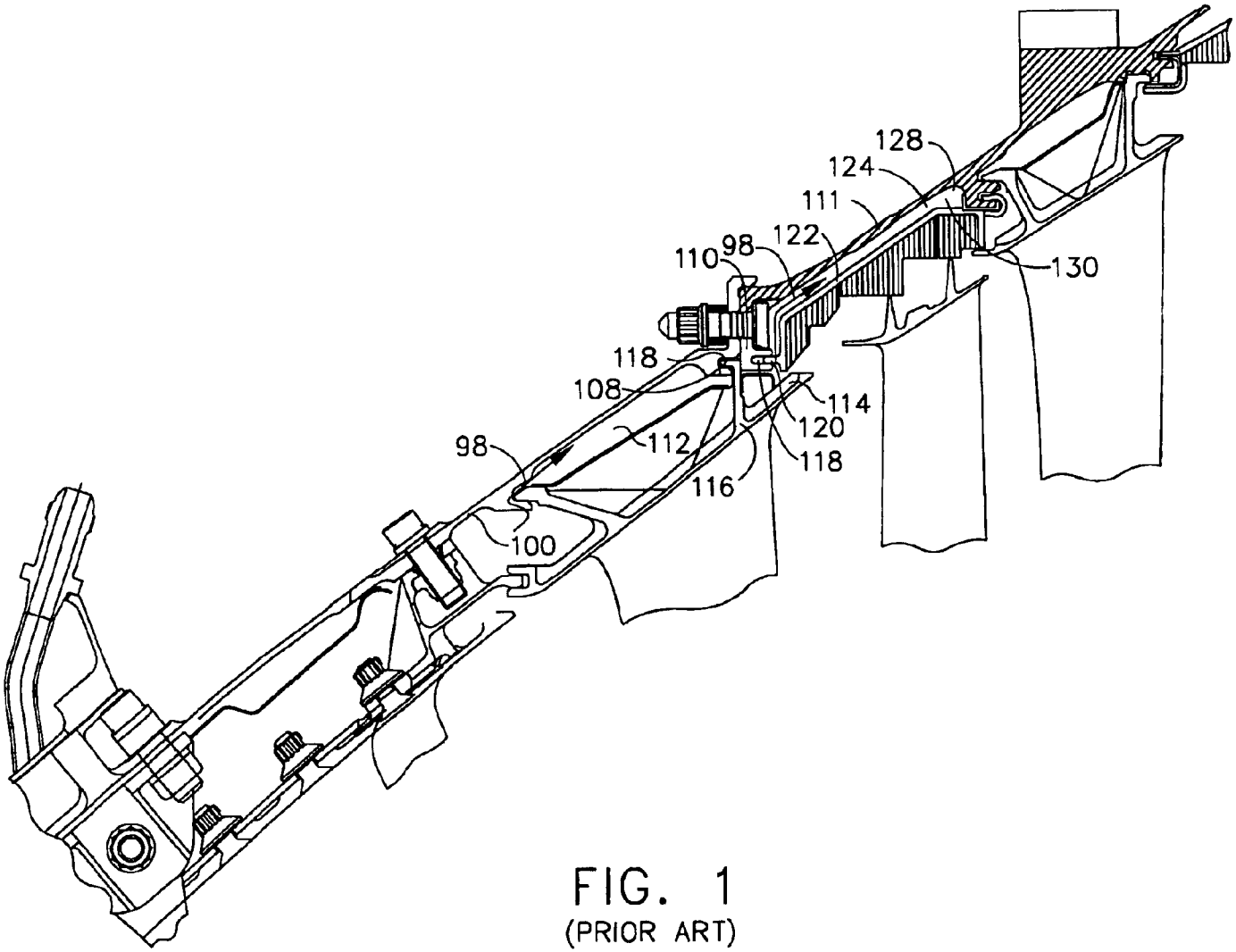
FIG. 1 (PRIOR ART)
FIG. 1 is a longitudinal cross-sectional view illustration of prior art first stage of a gas turbine engine low pressure turbine casing and shroud assembly.
Figure 2:
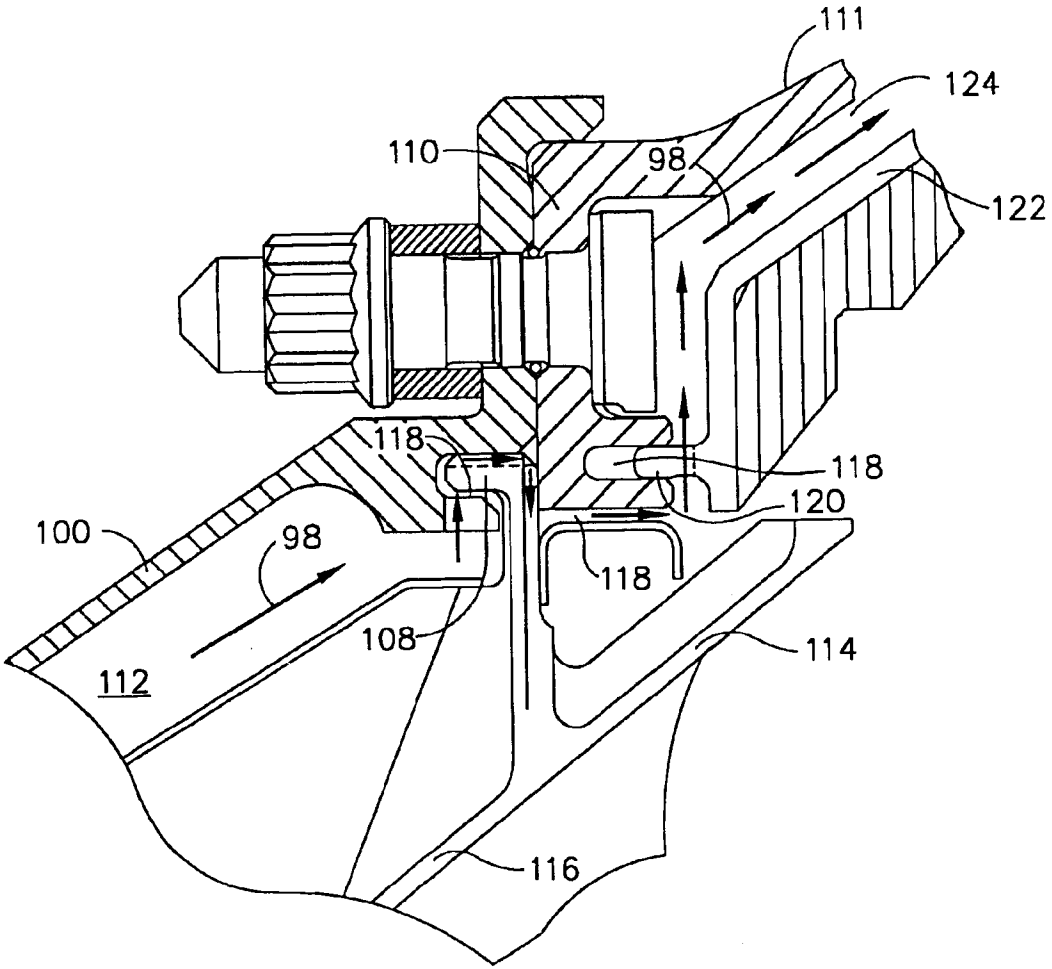
FIG. 2 (PRIOR ART)
FIG. 2 is an enlarged view of a prior art connection between a turbine nozzle and the casing and shroud assembly illustrated in FIG. 1.
Figure 3:
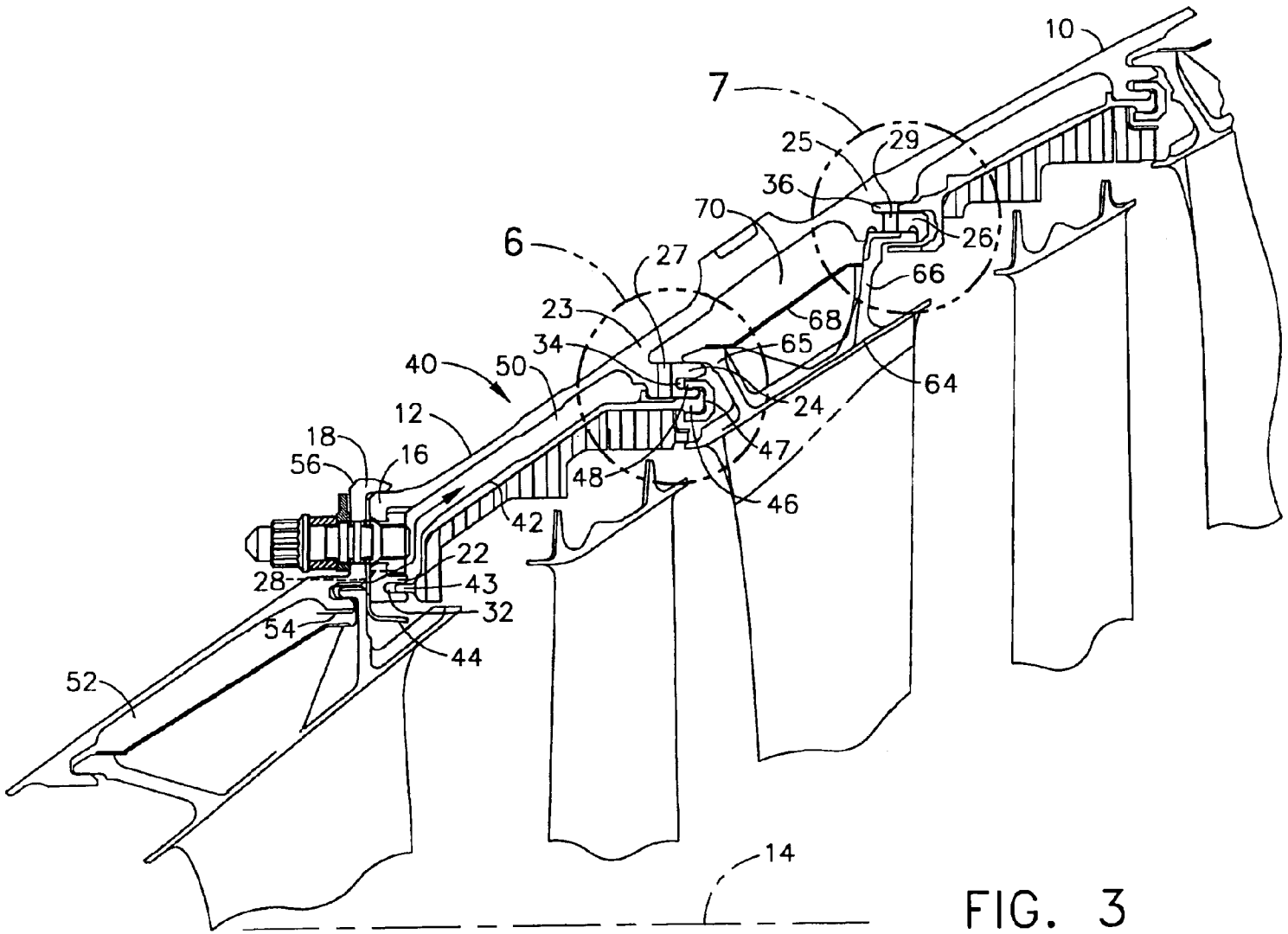
FIG. 3 is a longitudinal cross-sectional view illustration of an exemplary gas turbine engine low pressure turbine casing and shroud assembly in accordance with an exemplary embodiment of the invention.
Figure 6:
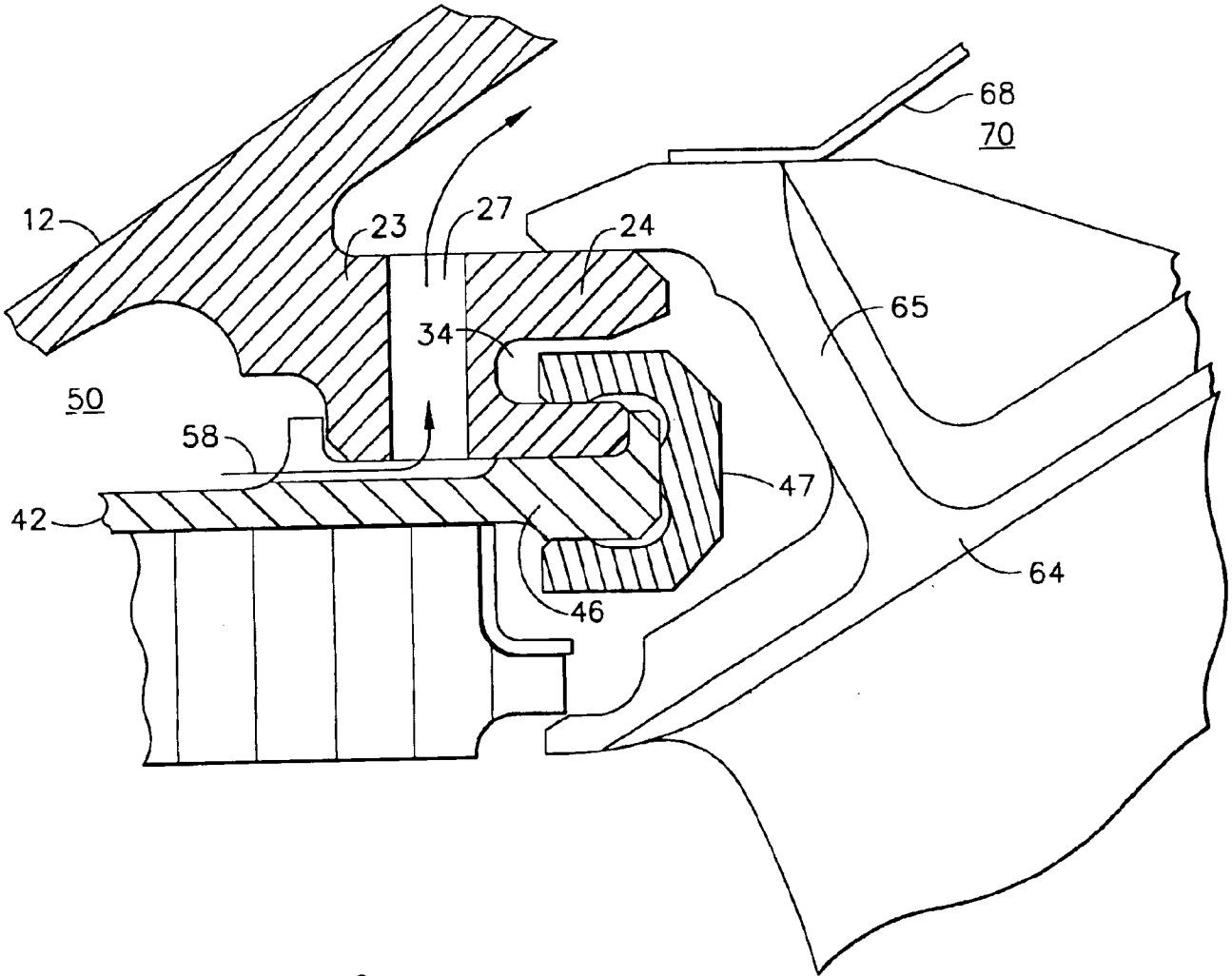
FIG. 6 is an enlarged longitudinal cross-sectional view illustration of a first hook with radial holes therethrough of the turbine casing and shroud assembly illustrated in FIG. 3.
Figure 7:
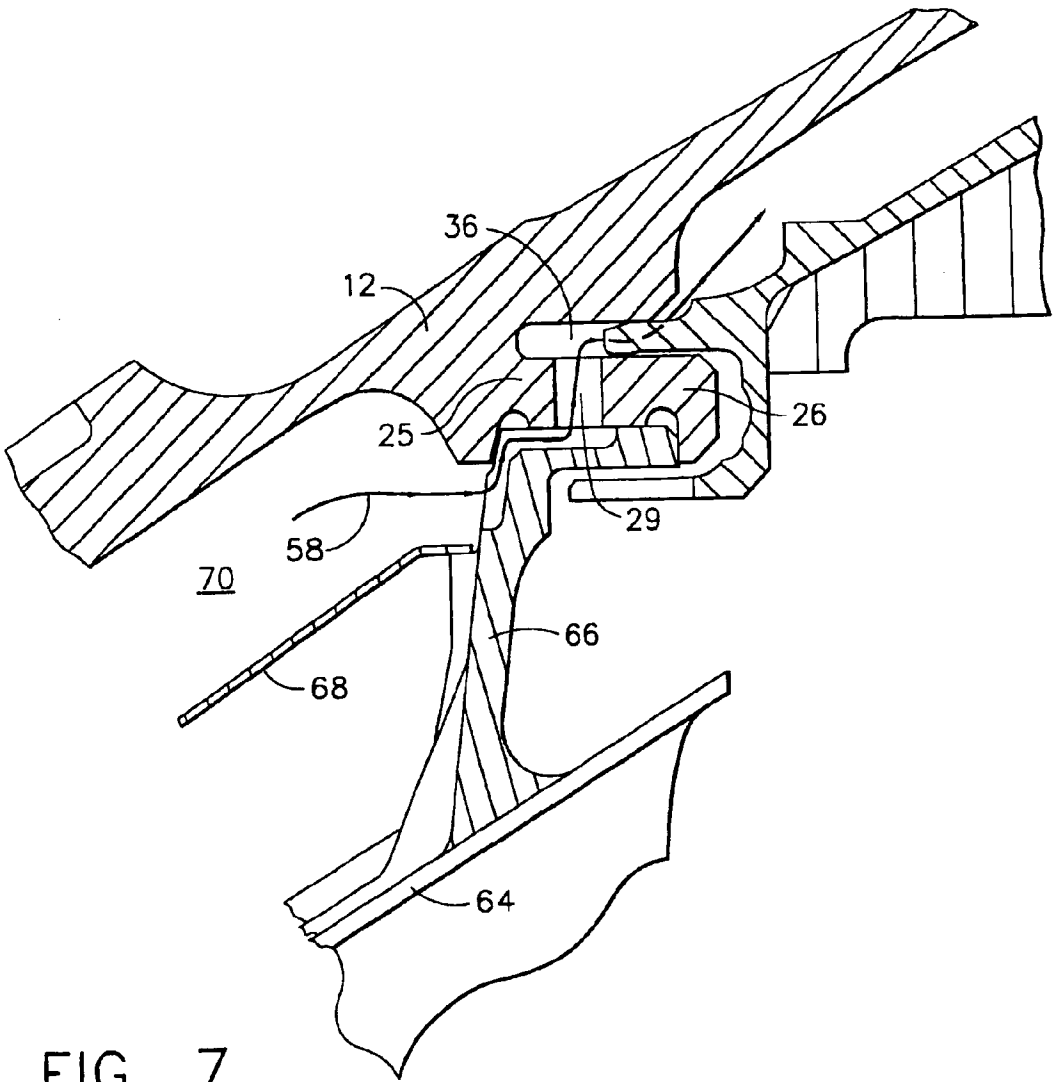
FIG. 7 is a longitudinal cross-sectional view illustration of a second hook with radial holes therethrough in the gas turbine engine low pressure turbine casing and shroud assembly illustrated in FIG. 3.

Illustrated in FIG. 3 is a low pressure turbine casing and shroud assembly 40 having a low pressure turbine casing 10 with a conical annular shell 12 circumscribed about a centerline 14. A forward flange 16 radially inwardly depends from a forward end 18 of the annular shell 12 and a forward hook 22 extends axially aftwardly from the forward flange 16. Referring to FIGS. 3, 6, and 7, axially spaced apart annular first and second rails 23 and 25 having first and second hooks 24 and 26, respectively, extend axially aftwardly from the annular shell 12 and are located axially aft of the forward hook 22. First and second hooks 24 and 26, include first and second annular slots 34 and 36, respectively. First and second pluralities of first and second cooling holes 27 and 29 extend through the first and second rails 23 and 25, respectively allowing cooling air 58 to flow therethrough.

Figure 4:
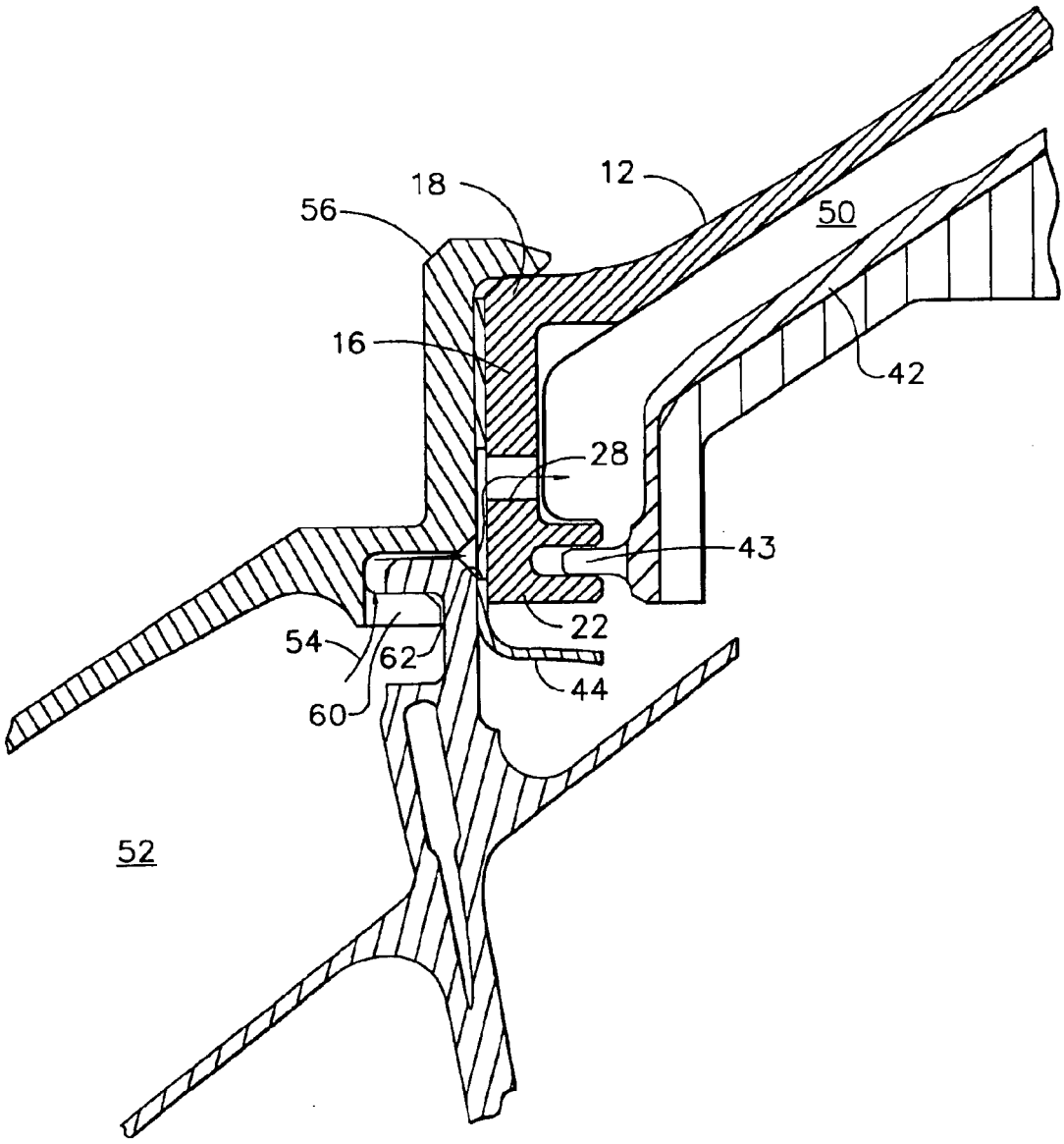
FIG. 4 is an enlarged longitudinal cross-sectional view illustration of an area around a forward flange of the turbine casing illustrated in FIG. 3.
Figure 5:
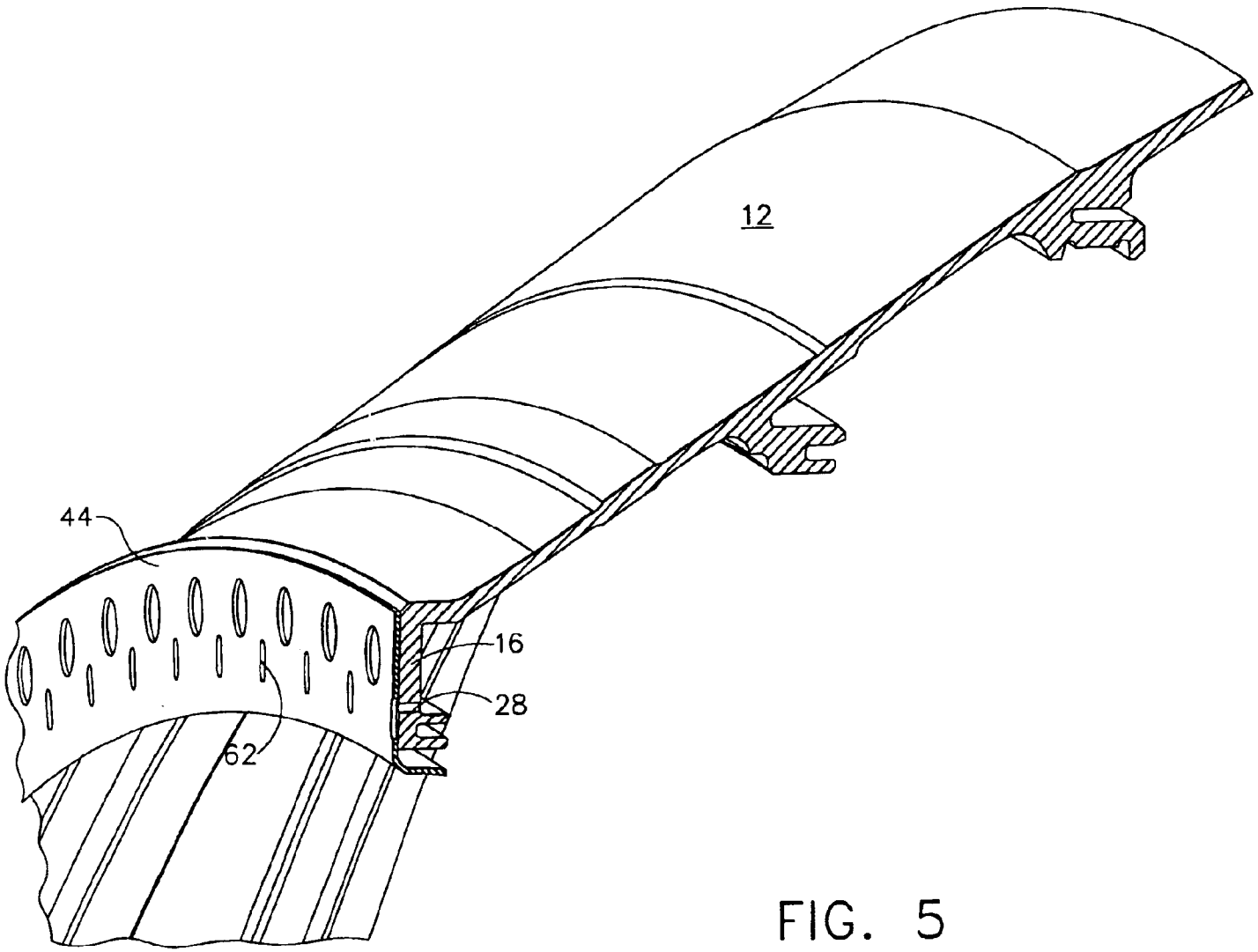
FIG. 5 is a perspective view illustration of a nozzle retainer sheet metal and the forward flange of the turbine casing illustrated in FIGS. 3 and 4.
Figure 8:
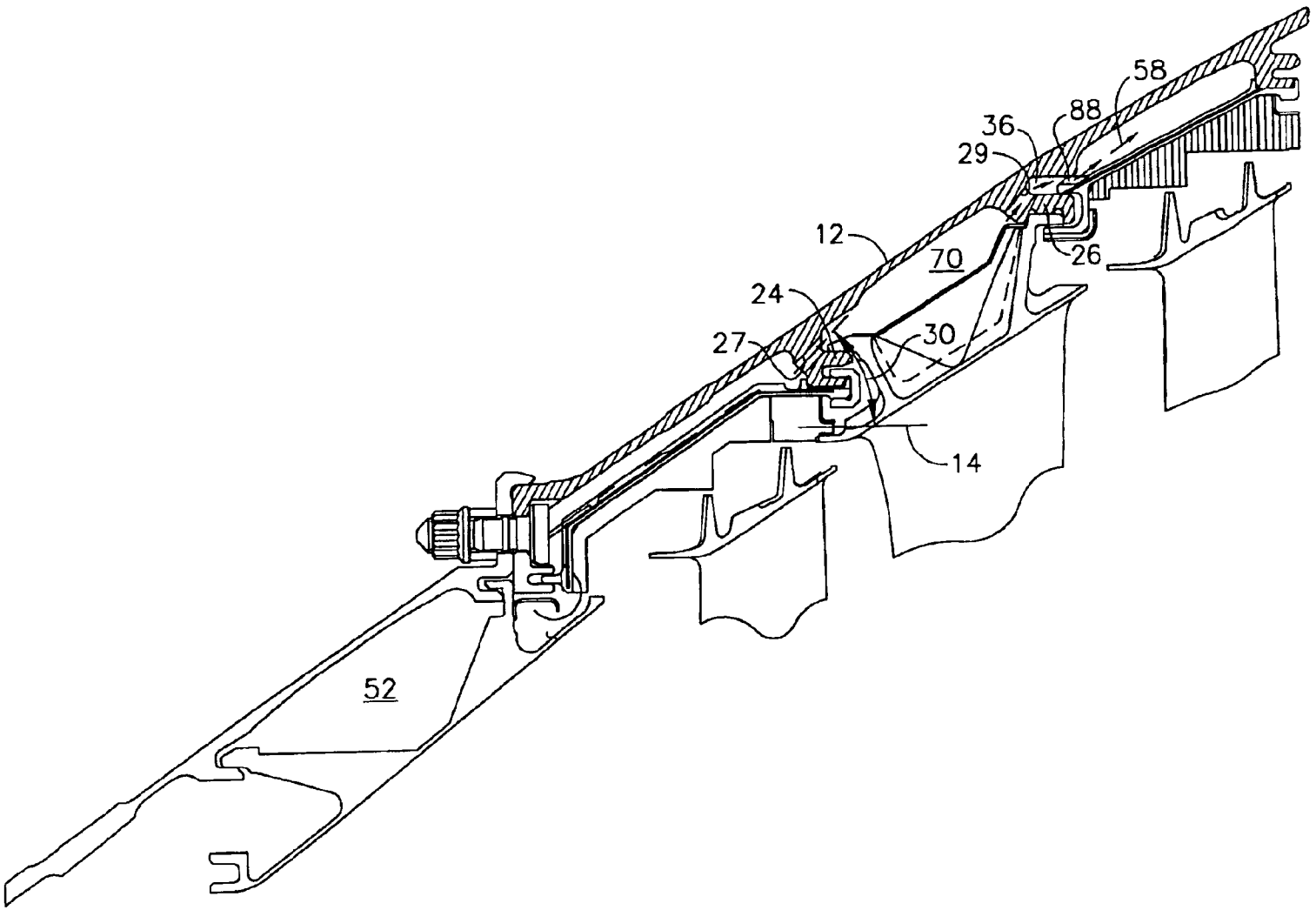
FIG. 8 is a longitudinal cross-sectional view illustration of a first alternative embodiment of the exemplary gas turbine engine low pressure turbine casing and shroud assembly illustrated in FIG. 3.

Referring to FIGS. 4 and 5, a plurality of cooling air feed holes 28 extend through the forward flange 16. The plurality of cooling air feed holes 28 may be substantially parallel to the centerline 14. The first and second pluralities of first and second cooling holes 27 and 29 may be radially disposed through the first and second rails 23 and 25, respectively, with respect to the centerline 14 or disposed through the first and second rails 23 and 25 at an oblique angle 30 with respect to the centerline 14 as illustrated in FIG. 8.

Referring to FIGS. 3, 4, 5, and 6, the low pressure turbine casing 10 in the low pressure turbine casing and shroud assembly 40 includes the forward flange 16 radially inwardly depending from the forward end 18 of the annular shell 12. The forward hook 22, extending axially aftwardly from the forward flange 16, includes a forward annular slot 32. An annular first shroud 42 is spaced radially inwardly of the annular shell 12 and has a forwardly extending first forward lip 43 disposed in the forward annular slot 32. An aft flange 46 of the first shroud 42 is mounted to the first hook 24 with an annular C-clip 47 having an annular radially outer leg 48 disposed in the first annular slot 34 of the first hook 24.

A first annular cavity 50 is radially disposed between the annular shell 12 and the first shroud 42, axially extends from the forward flange 16 to the first hook 24, and is in fluid flow communication with the first plurality of first cooling holes 27. An annular nozzle retainer 44 is axially trapped between a turbine flange 56 and the forward flange 16. Cooling air flow first passageways 54 extend from an annular cooling air plenum 52 through the turbine flange 56, the annular nozzle retainer 44, and the forward flange 16, to the first annular cavity 50. The first passageways 54 may include axially and radially open channels 60 through the turbine flange 56, radially elongated holes 62 extending axially through the annular nozzle retainer 44, and the plurality of cooling air feed holes 28 extending through the forward flange 16 to the first annular cavity 50. The radially open channels 60 are typically slots machined into the turbine flange 56.

Referring to FIGS. 3, 6, and 7, a radially outer turbine vane band 64 is suspended radially inwardly from the first and second hooks 24 and 26 by first and second turbine vane flanges 65 and 66. An annular seal 68 radially disposed between the annular shell 12 and the outer turbine vane band 64 and axially extends between the first and second turbine vane flanges 65 and 66. A second annular cavity 70 is radially disposed between the annular shell 12 and the annular seal 68, axially extends between the first and second rails 23 and 25, and is in fluid flow communication with the first and second pluralities of first and second cooling holes 27 and 29.

Figure 9:
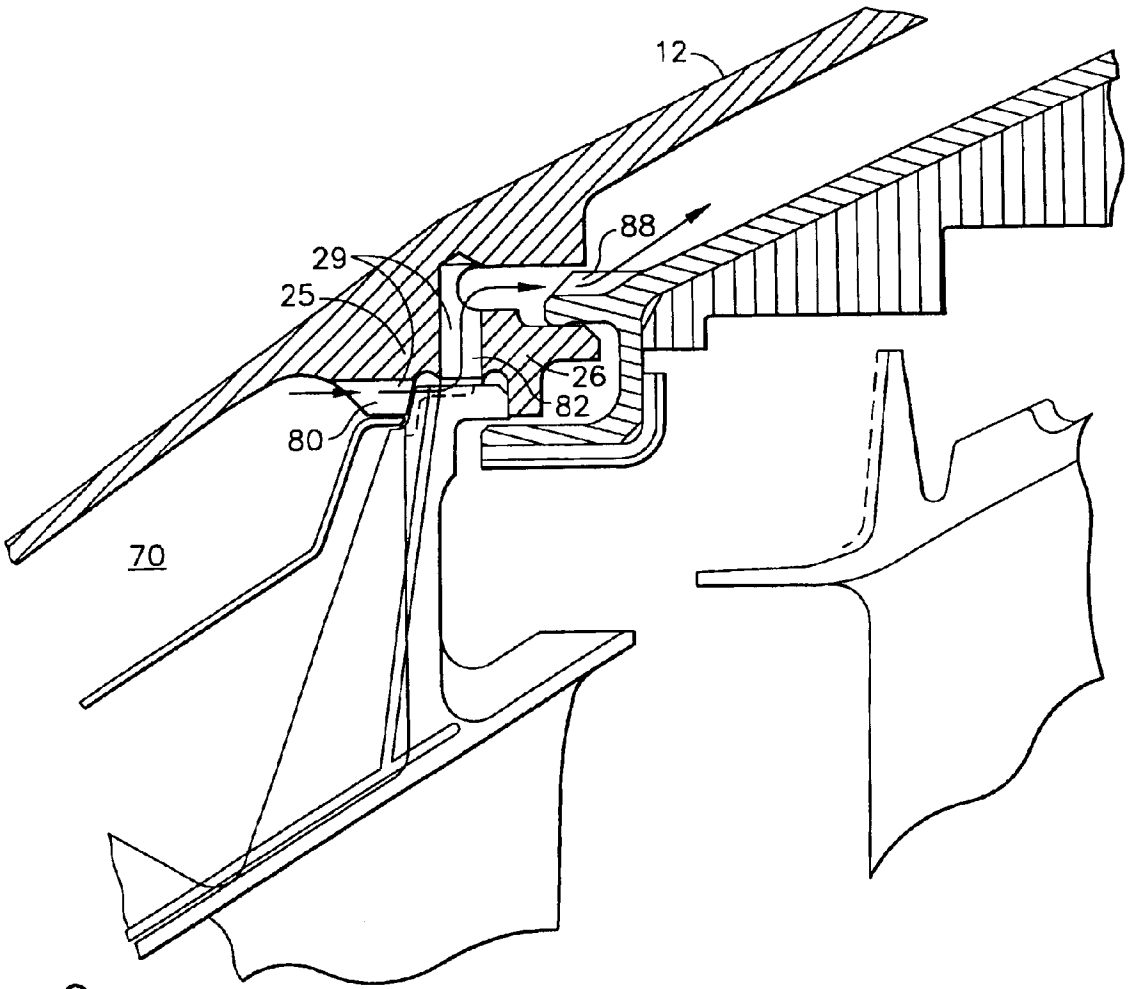
FIG. 9 is a longitudinal cross-sectional view illustration of a second alternative embodiment of the exemplary gas turbine engine low pressure turbine casing and shroud assembly illustrated in FIG. 3.

FIG. 8 further illustrates how the second cooling holes 29 may pass through one part of the hook 26 into the second annular slot 36 to exhaust the cooling air 58 from the second annular cavity 70 through scalloped passages 88 in the second hook 26. Illustrated in FIG. 9 are second cooling holes 29 may in a combination of axially extending forward holes 80 in combination with radially extending holes 82 disposed through the second rail 25 to exhaust the cooling air 58 from the second annular cavity 70.

The low pressure turbine casing 10 and low pressure turbine casing and shroud assembly 40 can reduce the amount of hot flowpath gases ingested into cavities between the casing and LPT shrouds and nozzle bands and reduce the amount of heat transferred into the casing by convection. This lowers the operating metal temperatures of the casing and, in turn, increases the useful service life of the casing whose materials are subject to heat enhanced low cycle fatigue.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

While the preferred embodiment of our invention has been described fully in order to explain its principles, it is understood that various modifications or alterations may be made to the preferred embodiment without departing from the scope of the invention as set forth in the appended claims.

What is claimed is:

1. A low pressure turbine casing comprising:

a conical annular shell circumscribed about a centerline, a forward flange radially inwardly depending from a forward end of said annular shell, a forward hook extending axially aftwardly from said forward flange, axially spaced apart annular first and second rails having first and second hooks, respectively, extending axially aftwardly from said annular shell and located axially aftwardly of said forward hook, and first and second pluralities of first and second cooling holes extending through said first and second rails, respectively.

2. A low pressure turbine casing as claimed in claim 1 further comprising a plurality of cooling air feed holes extending through said forward flange.

3. A low pressure turbine casing as claimed in claim 2 wherein said plurality of cooling air feed holes are substantially parallel to said centerline.

4. A low pressure turbine casing as claimed in claim 3 wherein said first and second pluralities of first and second cooling holes are radially disposed through said first and second rails, respectively, with respect to said centerline.

5. A low pressure turbine casing as claimed in claim 3 wherein said first and second pluralities of first and second cooling holes are disposed through said first and second rails at an oblique angle with respect to said centerline.

6. A low pressure turbine casing and shroud assembly comprising:

a low pressure turbine casing including a conical annular shell circumscribed about a centerline, a forward flange radially inwardly depending from a forward end of said annular shell, a forward hook having a forward annular slot and extending axially aftwardly from said forward flange, axially spaced apart annular first and second rails having first and second hooks with first and second annular slots, respectively, extending axially aftwardly from said annular shell and located axially aft of said forward hook, first and second pluralities of first and second cooling holes extending through said first and second rails, respectively, an annular first shroud spaced radially inwardly of said annular shell and having a forwardly extending first forward lip disposed in said forward annular slot, an aft flange mounted to said first hook with an annular C-clip having an annular radially outer leg disposed in said second annular slot, and a first annular cavity radially disposed between said annular shell and said first shroud and axially extending from said forward flange to said first hook and in fluid flow communication with said first plurality of first cooling holes.

7. An assembly as claimed in claim 6 further comprising a plurality of cooling air feed holes extending through said forward flange.

8. An assembly as claimed in claim 7 wherein said plurality of cooling air feed holes are substantially parallel to said centerline.

9. An assembly as claimed in claim 8 wherein said first and second pluralities of first and second cooling holes are radially disposed through said first and second rails, respectively, with respect to said centerline.

10. An assembly as claimed in claim 8 wherein said first and second pluralities of first and second cooling holes are disposed through said first and second rails at an oblique angle with respect to said centerline.

11. An assembly as claimed in claim 6 further comprising:

an annular nozzle retainer axially trapped between a turbine flange and said forward flange, cooling air flow first passageways extending from an annular cooling air plenum through said turbine flange, said annular nozzle retainer, and said forward flange, to said first annular cavity.

12. An assembly as claimed in claim 11 wherein said first passageways includes axially and radially open channels through said turbine flange, radially elongated holes extending axially through said annular nozzle retainer, and a plurality of cooling air feed holes extending through said forward flange, to said first annular cavity.

13. An assembly as claimed in claim 12 wherein said plurality of cooling air feed holes are substantially parallel to said centerline.

14. An assembly as claimed in claim 13 wherein said first and second pluralities of first and second cooling holes are radially disposed through said first and second rails, respectively, with respect to said centerline.

15. An assembly as claimed in claim 13 wherein said first and second pluralities of first and second cooling holes are disposed through said first and second rails at an oblique angle with respect to said centerline.

16. An assembly as claimed in claim 6 further comprising:

a radially outer turbine vane band suspended radially inwardly from said first and second hooks by first and second turbine vane flanges, an annular seal radially disposed between said annular shell and said outer turbine vane band and axially extending between said first and second turbine vane flanges, and a second annular cavity radially disposed between said annular shell and said annular seal, axially extending between said first and second rails, and being in fluid flow communication with said first and second pluralities of first and second cooling holes.

17. An assembly as claimed in claim 16 further comprising a plurality of cooling air feed holes extending through said forward flange.

18. An assembly as claimed in claim 17 wherein said plurality of cooling air feed holes are substantially parallel to said centerline.

19. An assembly as claimed in claim 18 wherein said first and second pluralities of first and second cooling holes are radially disposed through said first and second rails, respectively, with respect to said centerline.

20. An assembly as claimed in claim 18 wherein said first and second pluralities of first and second cooling holes are disposed through said first and second rails at an oblique angle with respect to said centerline.

21. An assembly as claimed in claim 16 further comprising:

an annular nozzle retainer axially trapped between a turbine flange and said forward flange, cooling air flow first passageways extending from an annular cooling air plenum through said turbine flange, said annular nozzle retainer, and said forward flange, to said first annular cavity.

22. An assembly as claimed in claim 21 wherein said first passageways includes axially and radially open channels through said turbine flange, radially elongated holes extending axially through said annular nozzle retainer, and a plurality of cooling air feed holes extending through said forward flange, to said first annular cavity.

23. An assembly as claimed in claim 22 wherein said plurality of cooling air feed holes are substantially parallel to said centerline.

24. An assembly as claimed in claim 23 wherein said first and second pluralities of first and second cooling holes are radially disposed through said first and second rails, respectively, with respect to said centerline.

25. An assembly as claimed in claim 23 wherein said first and second pluralities of first and second cooling holes are disposed through said first and second rails at an oblique angle with respect to said centerline.

* * * * *